United States Patent [19]

Echtler

[11] 4,440,543

[45] Apr. 3, 1984

[54] METHOD FOR STABILIZING A SLURRY OF FINELY DIVIDED PARTICULATE SOLIDS IN A LIQUID

[75] Inventor: J. Paul Echtler, Pittsburgh, Pa.

[73] Assignee: Conoco Inc., Wilmington, Del.

[21] Appl. No.: 291,596

[22] Filed: Aug. 10, 1981

Related U.S. Application Data

[63] Continuation of Ser. No. 152,073, May 21, 1980, abandoned.

[51] Int. Cl.[3] ..... C10L 1/32

[52] U.S. Cl. ..... 44/51; 406/45; 406/49; 252/313 R; 252/311

[58] Field of Search ..... 44/51; 252/313 R, 311, 252/8.5 A; 406/45, 49; 110/102, 347

[56] References Cited

U.S. PATENT DOCUMENTS

| | | | |
|---|---|---|---|
| 2,550,390 | 4/1951 | Stephanoff | 110/347 |
| 3,268,263 | 8/1966 | Van Olphen | 302/14 |
| 3,341,256 | 9/1967 | Adams | 406/49 |
| 3,405,976 | 10/1968 | Anderson et al. | 406/49 |
| 3,608,974 | 9/1971 | Wicks | 406/45 |
| 3,617,095 | 11/1971 | Lissant | 302/66 |
| 3,774,971 | 11/1973 | Shimizu et al. | 302/15 |
| 4,030,894 | 6/1977 | Marlin et al. | 44/51 |
| 4,127,391 | 11/1978 | Koppelman | 44/51 |

FOREIGN PATENT DOCUMENTS

| | | | |
|---|---|---|---|
| 835249 | 2/1970 | Canada | 302/17 |
| 1054784 | 5/1979 | Canada | 31/66 |

*Primary Examiner*—Charles F. Warren
*Assistant Examiner*—Mrs. Y. Harris-Smith
*Attorney, Agent, or Firm*—Dale Lovercheck; William A. Mikesell, Jr.

[57] ABSTRACT

A method for stabilizing a slurry of finely divided particulate solids in a liquid, the method consisting essentially of dispersing from about 1 to about 10 weight percent, based on the particulate solids, finely divided wood particles in the slurry, thereby improving the stability of the slurry.

2 Claims, No Drawings

METHOD FOR STABILIZING A SLURRY OF FINELY DIVIDED PARTICULATE SOLIDS IN A LIQUID

This is a continuation of application Ser. No. 152,073, filed May 21, 1980, now abandoned.

This invention relates to slurries of particulate solids in liquids.

This invention further relates to the use of wood particles to stabilize such slurries.

This invention further relates to the use of wood particles to stabilize aqueous slurries.

This invention further relates to the use of wood particles to stabilize slurries of carbonaceous solids in non-aqueous liquids such as oil, methanol etc.

In numerous industries solids are handled or transported by finely dividing the solids, if necessary, and thereafter transporting the solids as a slurry of the solids in a liquid. Such slurries are readily transported via pipelines and the like. Substantially any solid which is sufficiently non-reactive with the slurrying liquid can be so transported. Ores, coals of varying grades, fertilizer constituents, etc. have been transported by slurrying the solids in liquids and pipelining the resulting slurry. In many instances water is used as the slurry liquid especially when the sole objective is the transportation of the solids. Oils of varying grades have also been used especially for the transportation or handling of carbonaceous solids when the slurry itself is to be used as a fuel. In the transportation and handling of substantially any solid as a slurry the stability of the slurry is a problem, i.e. it is highly desirable that the solids remain in suspension for at least short periods of time when the slurry agitation is stopped, the flow through a slurry pipeline is interrupted etc. A second problem is the dispersibility of the solids when they have settled out of the slurry. For instance finely divided coals which have settled from aqueous slurries of coal in water are difficult to redisperse. Such difficulty in redispersing the solids coupled with a tendency for the solids to separate from the slurry can obviously result in major difficulties in the operation of slurry transportation or handling systems.

Numerous attempts to solve these problems have been proposed. Some references discovered in a prior art search directed to the concept of the present invention are: U.S. Pats. Nos.

3,268,263; issued Aug. 23, 1966 to Van Olphen
3,341,256; issued Sept. 12, 1967 to Adams
3,405,976; issued Oct. 15, 1968 to Anderson et al.
3,608,974; issued Sept. 28, 1971 to Wicks
3,617,095; issued Nov. 2, 1971 to Lissant
3,774,971; issued Nov. 27, 1973 to Shimizu et al.
4,030,894; issued June 21, 1977 to Marlin et al.
4,127,391; issued Nov. 28, 1978 to Koppelman These references are hereby incorporated in their entirety by reference.

U.S. Pat. No. 3,268,263 discloses a process wherein solid particles are suspended in a liquid which contains a coherent interlaced matrix of small thin pieces of a pliable material, with the material being substantially insoluble in the liquid and the matrix having over 90 percent, typically over 98 percent by volume of its spaces filled by the liquid. The matrix is provided by mixing a finely divided fibrous material such as cotton, hemp, paper or resins with the liquid.

It has now been found that slurries of finely divided solids in liquids can be stabilized by the addition of from about 1 to about 10 weight percent, based on the weight of the finely divided solids, finely divided wood particles. The resulting slurry is stabilized, i.e. exhibits a much reduced solids separation rate and further the settled solids after separation occurs are much more readily redispersed.

In the practice of the present invention substantially any type of wood can be used. The wood is ground or otherwise finely divided to a particle size which is desirably no larger than the largest solid particles contemplated in the slurry. The finely divided wood is added in a quantity sufficient to impart the desired stability to the slurry or dispersibility to the slurry solids. Quantities less than about 1 weight percent based on the weight of the slurry solids are not normally considered to provide a sufficient improvement in the stability of the slurry and dispersibility of the slurry solids although some improvement is achieved. Quantities greater than about 10 weight percent based on the weight of the solids are normally more than adequate but offer economic disadvantages disproportionate to the improvement beyond about 10 weight percent.

The use of wood does not appear to result in the presence of a fibrous matrix, but rather in the presence of discrete wood particles in the slurry. Accordingly the pumping and handling of the slurry is not adversely affected as a result of the presence of the wood particles. Further, it is believed that wood is much more readily divided into particles of a size smaller than the slurry solids by grinding etc. than are fibrous materials such as cotton, hemp, paper, resins etc. and that the wood has a lesser tendency to mat or otherwise join together to form larger masses in the slurry than fibrous materials. Some handling disadvantages are discussed with respect to fibrous materials in U.S. Pat. No. 3,268,263 previously incorporated by reference at column 3, lines 45–55.

The use of finely divided wood as discussed above is beneficial with a variety of slurries such as finely divided inorganic solids such as ores, fertilizer constituents and the like in water; carbonaceous solids such as coals of various grades, coal or petroleum derived solids and the like in water and carbonaceous solids such as coals of various grades and coal or petroleum derived solids in non-aqueous liquids such as oils, methanol etc.

The use of wood particles as discussed above in aqueous slurries of inorganic solids is beneficial but in some instances the wood particles may be considered an undesirable contaminant in the transported solids. In such cases, the wood particles may be removed by means known to the art as applicable to the specific solids involved. In some instances the wood particles may not be detrimental to the desired use for the slurry solids and in such instances the wood particles need not be removed.

In the use of aqueous slurries of carbonaceous solids in water or oil the wood particles generally need not be removed since they constitute a suitable fuel material in most instances where coal is used as a fuel. Further, the wood particles result in an improved dispersibility in storage vessels etc. where the slurry solids may tend to settle. Without the use of wood particles the slurry solids tend to settle into a relatively difficultly dispersed cake of solids. As indicated above, such settled solids are more readily redispersed when the settled solids include wood particles in an amount equal to from about 1 to about 10 weight percent based on the weight of the solids.

Since the wood particles are sized to be less than the size of the largest slurry solids and since they do not join together to a substantial extent in the liquid not only do they present substantially no problem in the pumping and handling of slurries containing the wood particles, but such slurries can also be used for direct injection into combination zones as a slurry. In some instances aqueous slurries of carbonaceous solids have been injected but more commonly oil slurries of coals of various grades have been used. Other liquids such as methanol etc. have also been proposed for such applications. The use of wood particles in such slurries facilitates handling and re-dispersion of the slurry solids if required and is suitable for use with slurries which are injected through nozzles for fine dispersion in a combustion zone.

As indicated previously the use of wood particles is beneficial with slurries of solids in liquids generally at the concentrations and operating conditions normally used.

Such concentrations and operating conditions are believed to be sufficiently well-known to the art that no further discussion is necessary.

While the use of wood particles as discussed is beneficial with slurries of solids in liquids in general highly desirable results are realized when wood particles are used with slurries of carbonaceous solids in oil, water etc. where the end use for the slurry solids is as a fuel. In such instances, the wood particles need not be separated from the carbonaceous solids since the wood particles are also a suitable fuel.

The wood may be ground by any means suitable as known to those skilled in the art. Typically the wood is ground to a size less than about 50 Tyler Mesh (297 Microns) and desirably to less than about 100 Tyler Mesh (149 Microns).

It is to be understood that the foregoing discussion of the invention by reference to its preferred embodiments is illustrative rather than limiting in nature and that many variations and modifications are possible within the scope of the present invention.

Having thus described the invention, I claim:

1. A method of providing stability of particle distribution and redispersibility in the transporting and combusting of coal in combustible liquid comprising the steps as follows:

storing a readily pumpable, readily redispersible slurry of solids mixture in a combustible liquid which is neither a pseudo-plastic nor a thixotropic fluid, said liquid not being highly viscose such as methanol said solids mixture comprising from about 90 to about 99 weight percent coal particles and from about 1 to about 10 weight percent finely divided wood particles, said wood particles being of a size less than the largest coal particles and each having a particle size no larger than about 50 Tyler mesh (297 microns), pumping said readily pumpable and redispersible solids mixture in said combustible liquid as a slurry with substantially no fibrous matrix being formed and said wood particles remaining discrete as a stable dispersible slurry, injecting said stable dispersible slurry through a nozzle means for fine dispersion in a combustion zone, combusting said slurry.

2. The method of claim 1 wherein coal particles and said wood particles each have a particle size no larger than about 100 Tyler mesh.

* * * * *